US007278751B2

(12) United States Patent
Chang et al.

(10) Patent No.: US 7,278,751 B2
(45) Date of Patent: Oct. 9, 2007

(54) SCREWDRIVER WITH ILLUMINATION

(76) Inventors: Shih-Chieh Chang, No. 499, Sec. 2, Nanshan Rd., Luzhu Shiang, Taoyuan County 33852 (TW); Juan-Hsin Lu, No. 499, Sec. 2, Nanshan Rd., Luzhu Shiang, Taoyuan County 33852 (TW)

( * ) Notice: Subject to any disclaimer, the term of this patent is extended or adjusted under 35 U.S.C. 154(b) by 121 days.

(21) Appl. No.: 11/174,868

(22) Filed: Jul. 5, 2005

(65) Prior Publication Data

US 2007/0008715 A1 Jan. 11, 2007

(51) Int. Cl.
*B25B 23/18* (2006.01)

(52) U.S. Cl. ..... 362/120; 362/119

(58) Field of Classification Search ..... 362/119, 362/120, 184, 202, 240, 375, 109, 157, 225, 362/227, 235, 236, 237, 800; 81/436, 177.1, 81/489; 408/16

See application file for complete search history.

(56) References Cited

U.S. PATENT DOCUMENTS 4,283,757 A * 8/1981 Nalbandian et al. ..... 362/120
4,480,295 A * 10/1984 Shuster ..... 362/206
5,713,656 A * 2/1998 Lin ..... 362/120
5,772,308 A * 6/1998 Lin ..... 362/119
5,845,986 A * 12/1998 Breen ..... 362/119
6,033,082 A * 3/2000 Lin ..... 362/120
6,079,846 A * 6/2000 Huang ..... 362/119

* cited by examiner

*Primary Examiner*—Jong-Suk (James) Lee
*Assistant Examiner*—David R Crowe
(74) *Attorney, Agent, or Firm*—Pro-Techtor Int'l Services

(57) ABSTRACT

A screwdriver includes a handle including a receptacle for coupling with an end of a bit. A front groove and a rear groove are respectively defined in a front end and a rear end of the handle. A plurality of light-emitting diodes are mounted on a circuit board in the front groove of the handle. A transparent cover is mounted in the front groove and in front of the light-emitting diodes. A front cap is mounted to the front end of the handle. A cell and a switch are mounted in the rear groove. A rear cap is mounted to the rear end of the handle. The switch, the cell, the circuit board, and the light-emitting diodes are electrically connected. The light-emitting diodes forwardly emit light beams passing through the transparent cover to provide illumination when required.

14 Claims, 3 Drawing Sheets

SCREWDRIVER WITH ILLUMINATION

BACKGROUND OF THE INVENTION

1. Field of the Invention

The present invention relates to a screwdriver. In particular, the present invention relates to a screwdriver with illumination.

2. Description of the Related Art

A typical screwdriver comprises a handle and a bit with a cabinet tip or Phillips head tip for engaging with a slot or a cruciform groove in an end of a screw or the like. However, the screwdriver has no illumination device and thus could not provide illumination such that the screw-driving operation is adversely affected when the environment is not bright enough. The user must hold a flashlight with one hand while operating the screwdriver with the other, which adversely affects the efficiency and results in a waste in time and labor.

SUMMARY OF THE INVENTION

An objective of the present invention is to provide a screwdriver with illumination.

A screwdriver in accordance with the present invention comprises a handle including a receptacle for coupling with an end of a bit. A front groove and a rear groove are respectively defined in a front end and a rear end of the handle. A plurality of light-emitting diodes are mounted on a circuit board in the front groove of the handle. A transparent cover is mounted in the front groove and in front of the light-emitting diodes. A front cap is mounted to the front end of the handle. A cell and a switch are mounted in the rear groove. A rear cap is mounted to the rear end of the handle.

The switch, the cell, the circuit board, and the light-emitting diodes are electrically connected. The light-emitting diodes forwardly emit light beams passing through the transparent cover to provide illumination when required.

Preferably, the switch further comprises an actuating end, and a push button is mounted in the rear cap and connected to the actuating end. On/off of the light-emitting diodes is controlled by pressing the push button.

Preferably, the screwdriver further comprises a battery seat, and a switch seat is engaged with a rear end of the battery seat.

Preferably, the front cap comprises a plurality of spaced slots. The transparent cover comprises a plurality of transparent positioning protruded sections that are respectively engaged in the slots and that accommodate distal, front ends of the respective light-emitting diodes.

Preferably, the slots are spaced and extend along a circumferential direction.

Preferably, the transparent protruded positioning sections extend along a circumferential direction.

Preferably, an inner edge delimiting each slot includes at least one hook for coupling with an edge of an associated one of the protruded positioning sections.

Preferably, the front end of the handle comprises a plurality of engaging holes in a circumference thereof, and the front cover further comprises a plurality of hooks on a circumference thereof for respectively coupling with the engaging holes.

Preferably, the receptacle is defined in a bottom wall delimiting the front groove of the handle.

Preferably, the handle further comprises two axial holes for communication between the front groove and the rear groove. Wires extend through the axial holes for providing electrical connection between the switch, the cell, the circuit board, and the light-emitting diodes.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
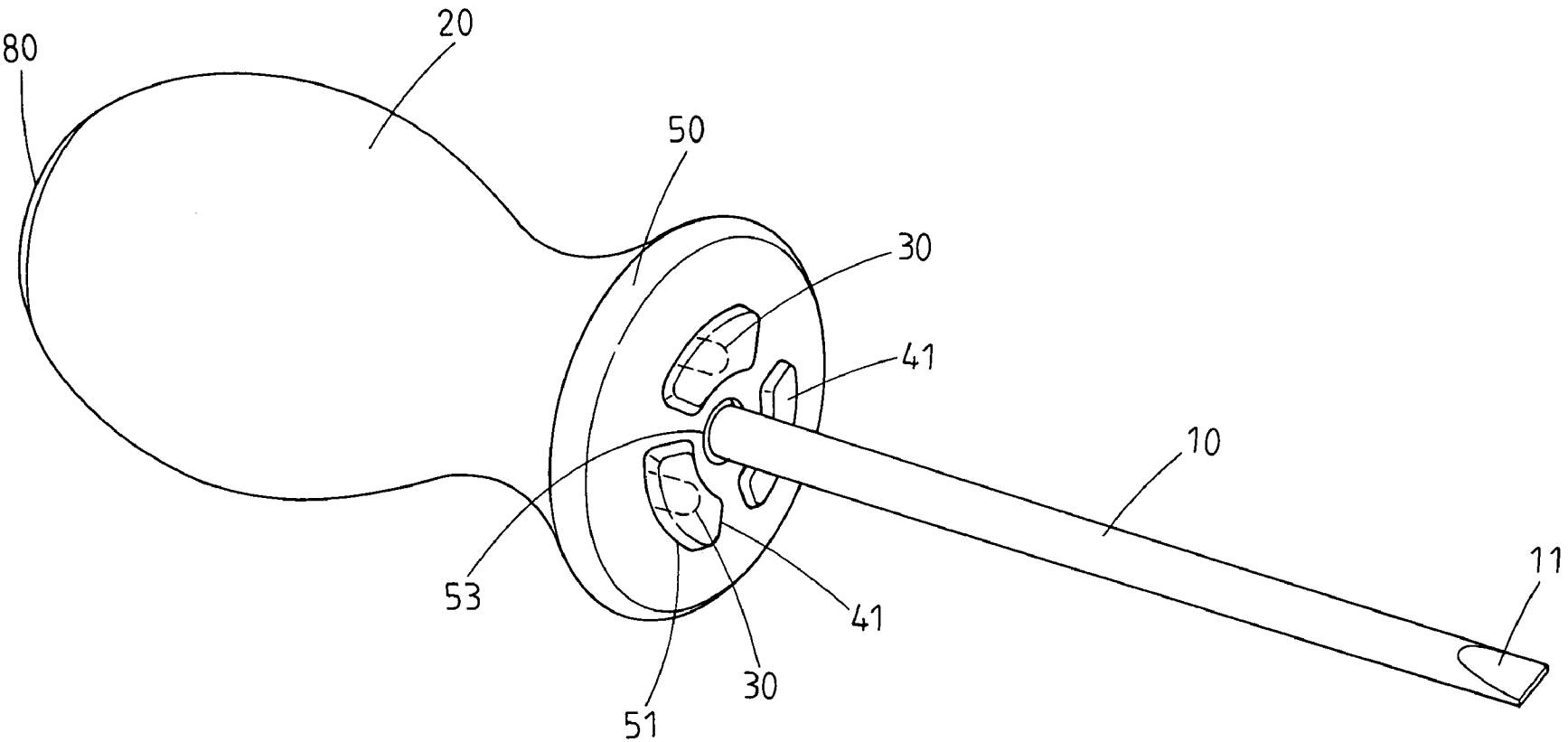
FIG. 1 is a perspective view of a screwdriver in accordance with the present invention.

Referring to FIG. 1, a screwdriver in accordance with the present invention comprises a handle 20, a bit 10 having a rear end removably attached to the handle 20, and an illumination device comprising a plurality of light-emitting diodes 30. The front end 11 of the bit 10 may include a cabinet tip or a Phillips head tip.

Figure 2:
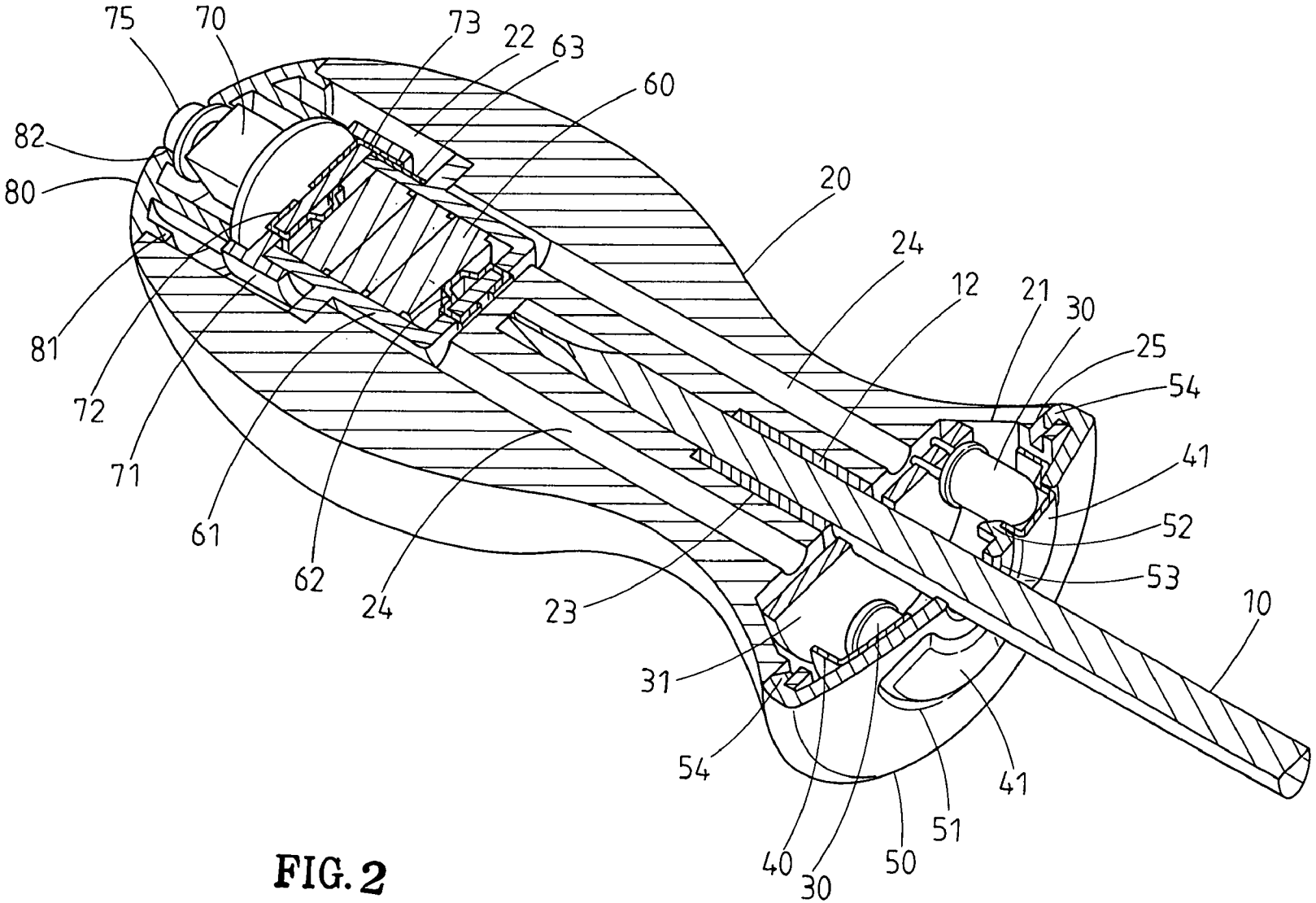
FIG. 2 is a longitudinal cutaway view of the screwdriver in accordance with the present invention.

Still referring to FIG. 1 and further to FIG. 2, the handle 20 comprises a front groove 21 and a rear groove 22 respectively in a front end and a rear end thereof. A receptacle 23 is defined in a bottom wall delimiting the front groove 21 of the handle 20. The rear end of the bit 10 is coupled in the receptacle 23. Preferably, a rubber sleeve 12 is mounted between the rear end of the bit 10 and a peripheral wall delimiting the receptacle 23. A circuit board 31 on which the light-emitting diodes 30 are mounted is mounted in the front groove 21. A transparent cover 40 is mounted in the front groove 21 and in front of the light-emitting diodes 30. A front cap 50 is mounted to the front end of the handle 20 and covers the front groove 21.

Each of the circuit board 31 and the transparent cover 40 includes a through-hole (not labeled) through which the bit 10 extends. The front cap 50 also includes a through-hole 53 through which the bit 10 extends. The front cap 50 further includes a plurality of spaced sectorial slots 51 extending along a circumferential direction. The transparent cover 40 includes a plurality of transparent protruded positioning sections 41 that are respectively engaged in the sectorial slots 51 and that accommodate distal, front ends of the respective light-emitting diodes 30. The light-emitting diodes 30 and the circuit board 31 are thus positioned. As illustrated in FIG. 2, an inner edge delimiting each sectorial slot 51 includes at least one hook 52 for coupling with an edge of an associated protruded positioning section 41. The front cap 50 further includes a plurality of hooks 54 on a circumference thereof for respectively coupling with a plurality of engaging holes 25 in a circumference of the front end of the handle 20.

Figure 3:
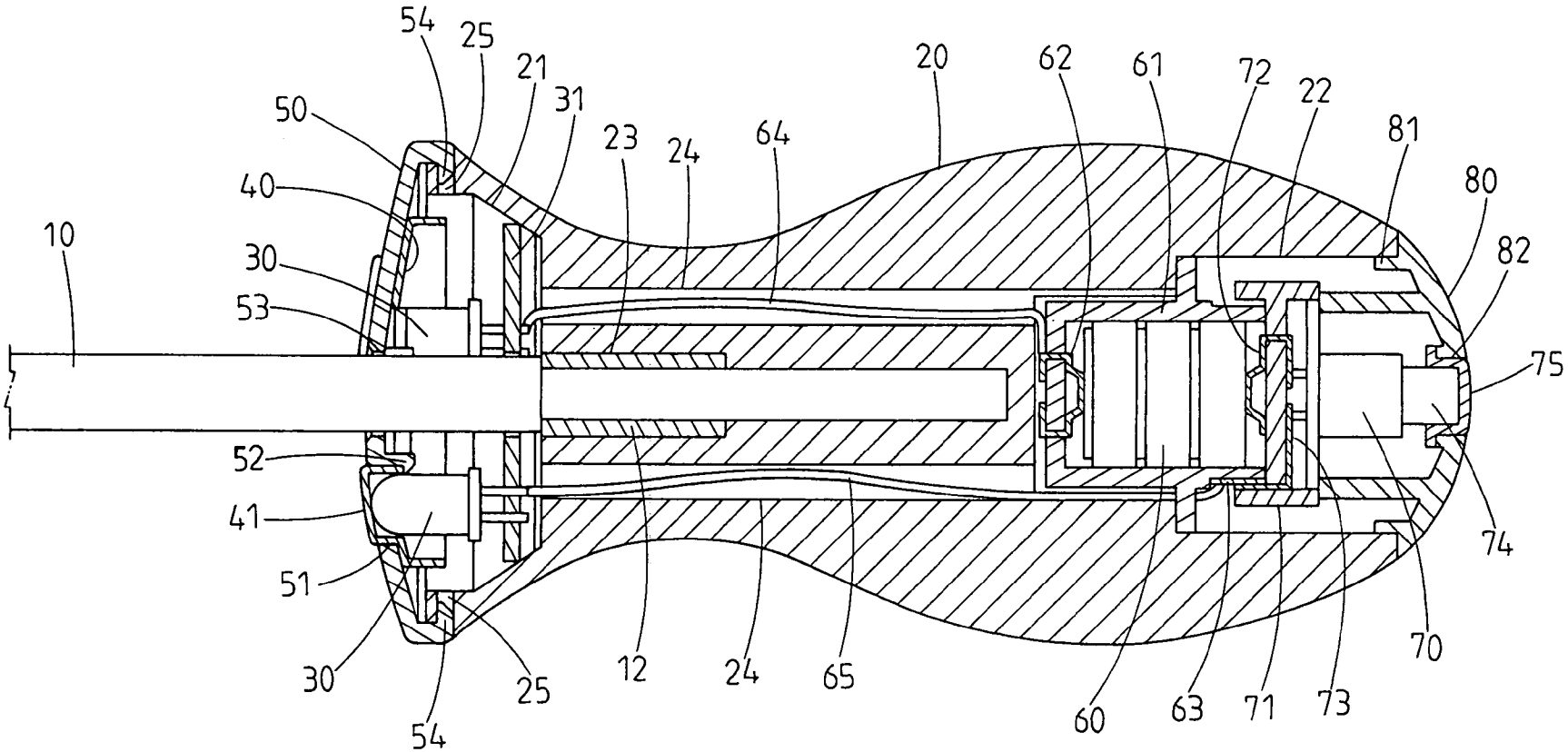
FIG. 3 is a sectional view of the screwdriver in accordance with the present invention after installation of wires.

As illustrated in FIGS. 2 and 3, the front groove 21 and the rear groove 22 are in communication with each other via two axial holes 24 in the handle 20. A battery seat 61 and a switch 70 are mounted in the rear groove 22, and a rear cap 80 is mounted to the rear end of the handle 20 for covering the rear groove 22. A cell 60 is mounted on the battery seat 61. The switch 70, the cell 60, the light-emitting diodes 30, and the circuit board 31 are electrically connected, which will be described in detail later.

As illustrated in FIGS. 2 and 3, a first conductive plate 62 is mounted on the battery seat 61 and in contact with, e.g., the positive terminal of the cell 60, and a second conductive plate 63 is mounted in the rear groove 22 and adjacent to the rear cap 80. The first conductive plate 62 and the second conductive plate 63 are electrically connected to contacts of the light-emitting diodes 30 and/or the circuit board 31 by wires 64 and 65 extending through the axial holes 24.

The switch 70 is mounted on a switch seat 71, which, in turn, is mounted on a rear end of the battery seat 61. The switch 70 includes two contacts to which a third conductive plate 72 and a fourth conductive plate 73 are electrically connected by welding. The third conductive plate 72 is in contact with the negative pole of the cell 60. The fourth conductive plate 73 is in contact with the second conductive plate 63. The switch 70 can be pushed to control on/off of the power supply from the cell 60 to the circuit board 31 and the light-emitting diodes 30.

The rear cap 80 includes an opening 82 to which a rear end of the switch 70 is received. The rear cap 80 further comprises a ring 81 extending forward from an inner side thereof for coupling with a circumferential edge delimiting the rear groove 22. In the illustrated embodiment, a push button 75 is attached to an actuating end 74 of the switch 70 and extends into the opening 82 of the rear cap 80.

In use, the push button 75 can be pressed to turn on the light-emitting diodes 30 that emit light beams forward via the transparent protruded positioning sections 41 of the transparent cover 40 for providing illumination while using the screwdriver. Thus, screws can be easily tightened or loosened under illumination when the environment is dark. The light-emitting diodes 30 are turned off when the push button 75 is pressed again.

Although a specific embodiment has been illustrated and described, numerous modifications and variations are still possible without departing from the essence of the invention. The scope of the invention is limited by the accompanying claims.

What is claimed is:

1. A screwdriver comprising:

a handle comprising a receptacle for coupling with an end of a bit, the handle further comprising a front groove in a front end thereof and a rear groove in a rear end thereof;

a circuit board mounted in the front groove of the handle, a plurality of light-emitting diodes being mounted on the circuit board;

a transparent cover mounted in the front groove and in front of the light-emitting diodes;

a front cap mounted to the front end of the handle;

a cell mounted in the rear groove; a switch mounted in the rear groove; and a rear cap mounted to the rear end of the handle;

the switch, the cell, the circuit board, and the light-emitting diodes being electrically connected, the light-emitting diodes forwardly emitting light beams passing through the transparent cover;

wherein the front cap comprises a plurality of spaced slots, the transparent cover comprising a plurality of transparent positioning protruded sections that are respectively engaged in the slots and that accommodate distal, front ends of the respective light-emitting diodes.

2. The screwdriver as claimed in claim 1, wherein the slots are spaced and extend along a circumferential direction.

3. The screwdriver as claimed in claim 2, wherein the transparent protruded positioning sections extend along a circumferential direction.

4. The screwdriver as claimed in claim 2, wherein an inner edge delimiting each said slot includes at least one hook for coupling with an edge of an associated one of the protruded positioning sections.

5. The screwdriver as claimed in claim 3, wherein an inner edge delimiting each said slot includes at least one hook for coupling with an edge of an associated one of the positioning protruded sections.

6. The screwdriver as claimed in claim 1, wherein the front end of the handle comprises a plurality of engaging holes in a circumference thereof, and wherein the front cap further comprises a plurality of hooks on a circumference thereof for respectively coupling with the engaging holes.

7. The screwdriver as claimed in claim 2, wherein the front end of the handle comprises" a plurality of engaging holes in a circumference thereof, and wherein the front cap further comprises a plurality of hooks on a circumference thereof for respectively coupling with the engaging holes.

8. The screwdriver as claimed in claim 3, wherein the front end of the handle comprises a plurality of engaging holes in a circumference thereof, and wherein the front cap further comprises a plurality of hooks on a circumference thereof for respectively coupling with the engaging holes.

9. The screwdriver as claimed in claim 4, wherein the front end of the handle comprises a plurality of engaging holes in a circumference thereof, and wherein the front cap further comprises a plurality of hooks on a circumference thereof for respectively coupling with the engaging holes.

10. The screwdriver as claimed in claim 5, wherein the front end of the handle comprises a plurality of engaging holes in a circumference thereof, and wherein the front cap further comprises a plurality of hooks on a circumference thereof for respectively coupling with the engaging holes.

11. The screwdriver as claimed in claim 1, wherein the receptacle is defined in a bottom wall delimiting the front groove of the handle.

12. The screwdriver as claimed in claim 1, wherein the handle further comprises two axial holes for communication between the front groove and the rear groove, and wherein the screwdriver further comprises wires extending through the axial holes for providing electrical connection between the switch, the cell, the circuit board, and the light-emitting diodes.

13. The screwdriver as claimed in claim 1, wherein the switch further comprises an actuating end, further comprising a push button mounted in the rear cap and connected to the actuating end.

14. The screwdriver as claimed in claim 1, wherein the screwdriver further comprises a battery seat having a rear end, and wherein the switch further comprises a switch seat engaged with the rear end of the battery seat.

* * * * *